US012286881B2

(12) United States Patent
Avrillaud

(10) Patent No.: US 12,286,881 B2
(45) Date of Patent: Apr. 29, 2025

(54) PULSED HIGH-POWER DRILL BIT AND DRILLING TOOL

(71) Applicant: I-CUBE RESEARCH, Toulouse (FR)

(72) Inventor: Gilles Avrillaud, Pinsaguel (FR)

(73) Assignee: I-CUBE RESEARCH, Toulouse (FR)

( * ) Notice: Subject to any disclaimer, the term of this patent is extended or adjusted under 35 U.S.C. 154(b) by 0 days.

(21) Appl. No.: 18/273,951

(22) PCT Filed: Jan. 31, 2022

(86) PCT No.: PCT/EP2022/052229
§ 371 (c)(1),
(2) Date: Jul. 24, 2023

(87) PCT Pub. No.: WO2022/167370
PCT Pub. Date: Aug. 11, 2022

(65) Prior Publication Data

US 2024/0410229 A1 Dec. 12, 2024

(30) Foreign Application Priority Data

Feb. 4, 2021 (FR) ..... 2101063

(51) Int. Cl.
*E21B 7/15* (2006.01)
*E21B 10/43* (2006.01)
*E21B 10/567* (2006.01)

(52) U.S. Cl.
CPC ..... *E21B 7/15* (2013.01); *E21B 10/43* (2013.01); *E21B 10/567* (2013.01)

(58) Field of Classification Search
CPC ..... E21B 7/15; E21B 10/43; E21B 10/567
See application file for complete search history.

(56) References Cited

U.S. PATENT DOCUMENTS 9,976,352 B2 * 5/2018 Fraser ..... E21C 37/16
2008/0277508 A1 * 11/2008 Moeny ..... E21B 7/15 241/1

(Continued)

FOREIGN PATENT DOCUMENTS

CN 109 577 864 A 4/2019
WO 2011/031942 A2 3/2011

(Continued)

OTHER PUBLICATIONS

Search Report from the French Intellectual Property Office on corresponding FR application (FR 2101063) dated Oct. 1, 2021.

(Continued)

*Primary Examiner* — D. Andrews
(74) *Attorney, Agent, or Firm* — Alumen IP Law PC

(57) ABSTRACT

Drill bit (230) for a drilling tool (1) comprising a drill bit member (231) which delimits a through-channel (231C) for the passage of the fluid flow and comprising an external surface (232), from which there extend a plurality of drilling members (233) which are uniformly distributed over the external surface (232), each drilling member (233) comprising a fin (233A) which extends from the external surface (232) and a plurality of drilling teeth (233B) which extend from the fin (233A) and which each comprise a base (233B1) and a cutting element (233B2) which is arranged at the end of the base (233B1), the drill bit comprising a high-voltage electrode (232C) which is arranged at the centre of the central facial opening (231A1) and each drilling member (233) comprising an earth electrode (233C) which is positioned at the end of the fin (233A), at the high-voltage electrode (232C), so as to at least partially extend in line with the central facial opening (231A1).

15 Claims, 2 Drawing Sheets

(56) References Cited

U.S. PATENT DOCUMENTS

| | | | | |
|---|---|---|---|---|
| 2009/0188720 | A1* | 7/2009 | Johnson | E21B 7/06 175/76 |
| 2021/0396079 | A1* | 12/2021 | Staack | E21B 4/02 |

FOREIGN PATENT DOCUMENTS

| | | | |
|---|---|---|---|
| WO | 20 140 460 | A1 | 10/2015 |
| WO | 2017/033059 | A1 | 3/2017 |
| WO | 2020/092559 | A1 | 5/2020 |
| WO | 2020/098415 | A1 | 5/2020 |

OTHER PUBLICATIONS

International Search Report and Written Opinion on corresponding PCT application (PCT/EP2022/052229) from International Searching Authority (EPO) dated Mar. 3, 2022.

* cited by examiner

[Fig 1]
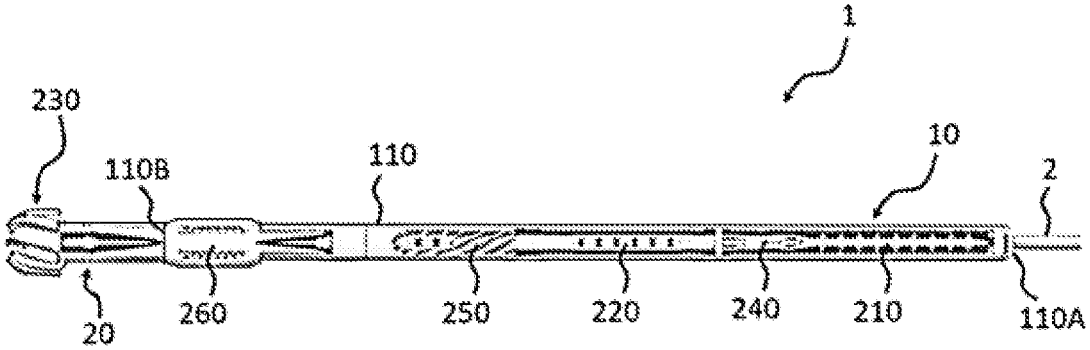
[Fig 2]
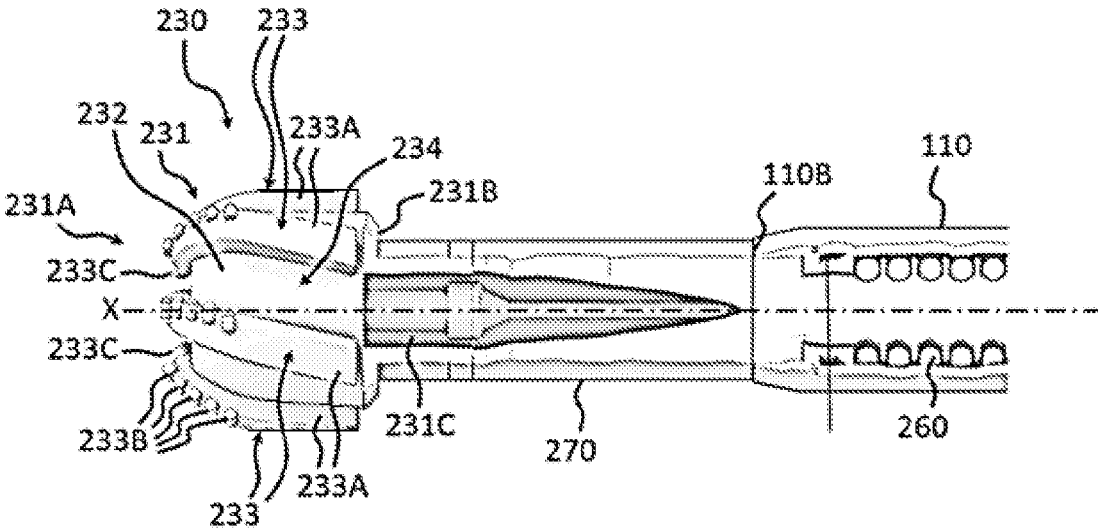

[Fig 3]
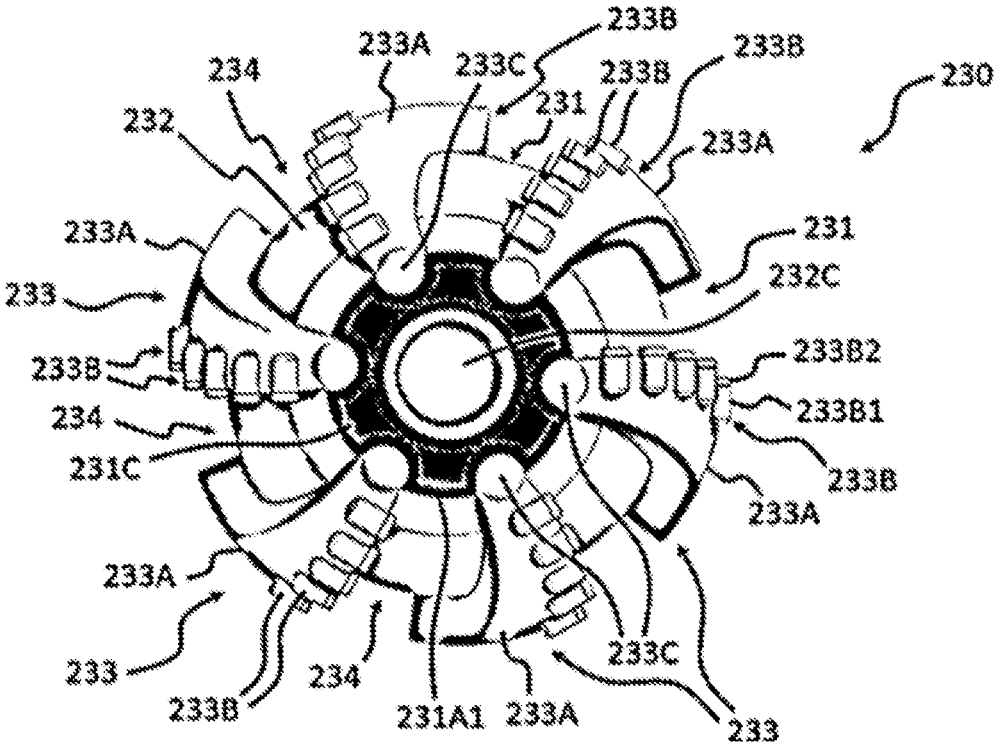
[Fig 4]
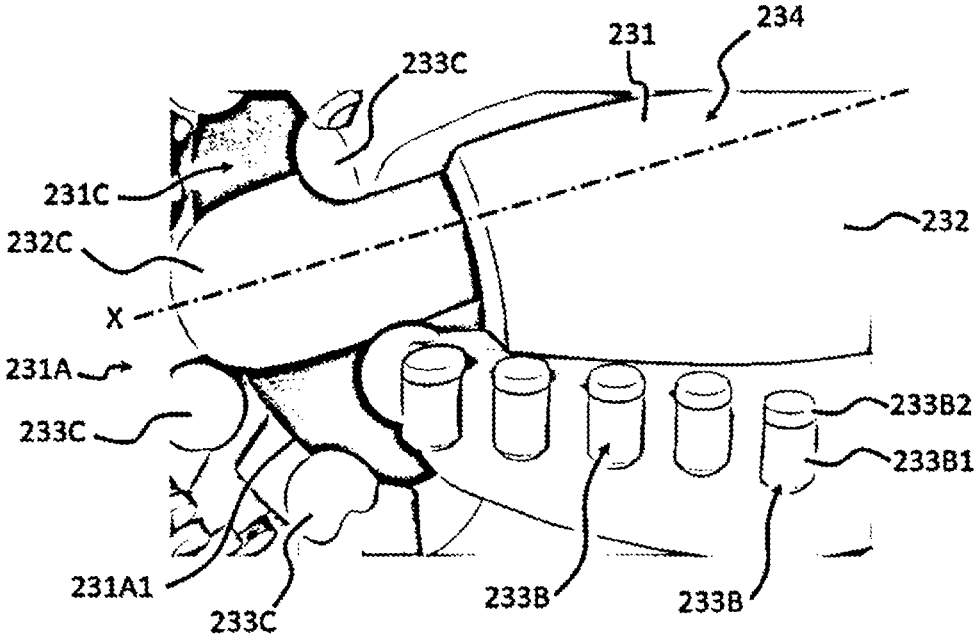

PULSED HIGH-POWER DRILL BIT AND DRILLING TOOL

TECHNICAL FIELD

The present invention deals with the field of drilling and relates more particularly to a pulsed high-power rotary drilling tool.

BACKGROUND

In the field of drilling, it is known to use rotary drilling tools to excavate rock. In a known solution, this type of tool comprises a bit with teeth that excavates the soil or rock by rotation. Such purely mechanical rotary drilling may be particularly time-consuming in particular for hard rock.

Another known solution is to use a pulsed high-power tool that triggers electric arcs in rock from a high-voltage electrode and a ground electrode subjected to a high potential difference, for example in the order of a few tens of kilovolts to a few hundred kilovolts. However, this solution only breaks the rock at the pair of electrodes, which may make the process still relatively time consuming.

Document U.S. Pat. No. 8,172,006 B2 relates to a drilling tool whose bit comprises electro-grinding electrodes. In one embodiment described in FIG. 5 of this document, the bit comprises both teeth and a high-voltage electrode surrounded by an annular ground electrode. Electrical pulses are therefore only concentrated in the center of the head of the tool, which may limit its effectiveness and therefore have a drawback. Furthermore, the electrodes may be damaged because they are directly exposed to the rock during rotation of the bit. In one embodiment described in FIG. 6 of this document, the bit comprises rows of teeth, a high-voltage electrode and a remote electrode disposed in place of a row of teeth. However, with this configuration, the electrical pulses are only concentrated on one side of the tool, which may limit its efficiency and therefore again have a drawback. Furthermore, the electrodes may be damaged because they are directly exposed to the rock during rotation of the bit. In the embodiments in FIGS. 35 to 37 of this prior art, the tool is without teeth and is not rotary to avoid damaging the electrodes. High-voltage electrodes are distributed in the center of the front face of the bit and ground electrodes are distributed around the high-voltage electrodes, at the periphery of the front face of the bit. This configuration has the drawback of requiring a lot of energy to generate pulses between each of the high-voltage electrodes and a ground electrode. Then, drilling may be time consuming with such a tool as it is only electrically powered and not mechanically rotary. Furthermore, it is not certain that the electrical pulses are generated effectively, as this depends on the dielectric nature of the medium between the high-voltage electrodes and the ground electrodes.

There is therefore a need for a simple and effective solution to overcome at least some of these drawbacks.

SUMMARY

For this purpose, the invention relates firstly to a bit for drilling tool, said bit comprising a bit body having a drilling face and a face for attaching the bit to a rotor assembly of the drilling tool, said bit body delimiting a through channel for passing the fluid flow connecting the attachment face to the drilling face by opening at a circular central face opening of the drilling face, the drilling face comprising an outer surface connecting the central face opening to the attachment face and from which a plurality of drilling members evenly distributed on said outer surface extend, each drilling member comprising a fin, extending radially from the outer surface from the attachment face into the central face opening, and a plurality of drilling teeth extending from said fin by being disposed side-by-side between a first drilling tooth located at the end of the drilling face and a last drilling tooth located on the side of the attachment face, and each comprising a base and a cutting element disposed at the end of said base, the bit comprising a high-voltage electrode disposed in the through channel, in the center of the central face opening recessed from the first drilling tooth of each drilling member, each drilling member comprising a ground electrode placed at the end of the fin, at said high-voltage electrode, so as to extend at least partially in line with the central face opening recessed from the first drilling tooth of said drilling member.

Each pair of electrodes formed by the high-voltage electrode and a ground electrode is configured to trigger an electric arc when said pair receives a voltage delivered across the same by the high-power pulse generator. Thus, as it passes through the bit body to open at the central face opening, the through channel allows the fluid flow to be conveyed through the bit so that the fluid circulates continuously around the high-voltage electrode, thus forming a fluid screen having a dielectric element function allowing the arc to form between the high-voltage electrode and one of the ground electrodes. When the rotor assembly is rotatably driven by the turbine, the bit rotates on itself to mechanically excavate the rock using the teeth. In doing so, the ground electrodes have a tangential velocity greater than the tangential velocity of the high-voltage electrode, which is close to zero since the high-voltage electrode is located in the center of the front face of the bit body. Thus, when voltage is applied between the high-voltage electrode and the ground electrodes, an electric arc is generated between the high-voltage electrode and one of the ground electrodes and through the rock while the bit is rotating. Such an arrangement and operation allows the rotating bit to be as close as possible to the area being weakened by electrical fragmentation while protecting the high-voltage electrode and ground electrodes from direct friction on the rock. The fluid circulating between the high-voltage electrode and the ground electrodes has a dual function: a dielectric element function because, between the fluid and the rock, the electric arc will favor passage through the rock and thus fracture it and a drilling mud function as the circulation of the fluid allows the rock debris to be discharged, by conveying it to the surface. Furthermore, the fluid flow allows cleaning of the inter-electrode zone.

According to one aspect of the invention, the drilling members are evenly distributed on the outer surface around the bit body in order to improve the drilling efficiency, especially mechanical drilling, while allowing drilling mud to flow between the drilling members.

Preferably, the bit body comprises at least three drilling members, preferably four, five, or six drilling members to improve drilling efficiency while allowing drilling mud to flow between the drilling members.

According to a characteristic of the invention, the fins are made as one piece with the outer surface of the bit body in order to improve the solidity of the bit and thus the drilling efficiency.

According to another characteristic of the invention, the bases of teeth of a drilling member are made as one piece with the fin of said drilling member in order to improve the solidity of the bit and thus the drilling efficiency.

Preferably, the fins extend on the outer surface in a curve manner in the opposite sense to the rotation of the bit for a drilling efficiency purpose.

Preferably still, each drilling member comprises at least three drilling teeth, preferably four, five, or six drilling teeth in order to improve the drilling efficiency.

According to a characteristic of the invention, the base is substantially cylindrical in shape by extending in an orthogonal direction to the axis of rotation of the bit in order to make the teeth solid and thus improve the drilling efficiency and service life of the tool.

Advantageously, the cutting elements are made of a hard, abrasive drilling material, for example from interconnected polycrystalline diamond particles, especially the "polycrystalline diamond compact" (PDC) type.

Preferably, as the ground electrodes are identical, the high-voltage electrode and the ground electrodes each have at least partially a spherical shape in order to slow down the erosion of the electrodes. Alternatively, the electrodes could have a pointed shape, for example conical, or any other adapted shape.

In one embodiment, the electrodes each having at least partially a spherical shape, the diameter of the high-voltage electrode is at least equal to twice the diameter of each ground electrode in order to allow the formation of an electric arc between the high-voltage electrode and any of the ground electrodes.

According to one aspect of the invention, the high-voltage electrode and the six ground electrodes are made of an electrically conductive material, for example metal such as, preferably, steel.

The invention also relates to a high-pulse rotary drilling tool, said drilling tool comprising a stator assembly and a rotor assembly, said stator assembly comprising a hollow cylindrical body comprising an attachment end adapted to be connected to a drilling rod and a free end, said rotor assembly comprising a turbine, mounted inside the body at the attachment end and configured to be driven by a fluid flow provided by the drilling rod in order to rotatably drive said rotor assembly, a high-power pulse generator mounted inside the body and integrally connected to the turbine and a bit as set forth previously extending out of the cylindrical body at the free end of the stator assembly.

In one embodiment, the drilling tool further comprises an electricity generator configured to convert the mechanical energy of the rotating turbine into electrical energy in order to supply the high-power pulse generator.

Preferably, the generator is mounted inside the stator assembly.

Advantageously, the drilling tool further comprises a drilling motor mounted inside the body, integrally connected to the high-power pulse generator and configured to be driven by the fluid flow having passed through the turbine.

Advantageously, the drilling tool further comprises a steering device integrally connected to the bit and being in the form of a hinged tube configured to receive the power provided by the turbine or the increased power provided by the drilling motor and transmit said power to the bit, to direct the bit in a given direction and to transfer the fluid flow from the turbine to the bit.

BRIEF DESCRIPTION OF THE DRAWINGS

Further characteristics and advantages of the invention will further appear upon reading the description that follows. This is purely illustrative and should be read in conjunction with the appended drawings in which:

FIG. 1 is a cutaway partial side view of an embodiment of a drilling tool according to the invention.

FIG. 2 is a perspective partial side view of the bit and the device for steering the tool of FIG. 1.

FIG. 3 is a front view of the bit of the tool of FIG. 1.

FIG. 4 is a perspective partial side view of the bit of FIG. 1, showing especially some of the teeth.

DETAILED DESCRIPTION

An example of a drilling tool 1 according to the invention is represented in the figures. The drilling tool 1 is rotary and has pulsed high powers.

I) Drilling Tool 1

With reference to FIG. 1, the drilling tool 1 comprises a stator assembly 10 and a rotor assembly 20.

1) Stator Assembly 10

The stator assembly 10 comprises a hollow cylindrical body 110 comprising an attachment end 110A, adapted to be connected to a drilling rod 2, and a free end 110B.

2) Rotor Assembly 20

The rotor assembly 20 comprises a turbine 210, a high-power pulse generator 220 and a bit 230. In this preferred but not limiting example, the drilling tool 1 further comprises an electricity generator 240, a drilling motor 250, and a steering device 260.

a) Turbine 210

The turbine 210 is mounted inside the body 110 of the stator assembly 10 at the attachment end 110A and is configured to be driven by a fluid flow provided by the drilling rod 2 in order to rotatably drive said rotor assembly 20.

b) Electricity Generator 240

The electricity generator 240 is configured to convert the mechanical energy of the rotating turbine 210 into electrical energy.

c) High-Power Pulse Generator 220

The high-power pulse generator 220 is mounted inside the body 110 of the stator assembly 10 and is integrally connected to the turbine 210.

d) Drilling Motor 250

The drilling motor 250 is a "mud motor" type. The drilling motor 250 is mounted inside the body 110 of the stator assembly 10 by being integrally connected to the high-power pulse generator 220 and is configured to be driven by the fluid flow having passed through the turbine 210 in order to increase the torque generated by the turbine 210 and provide it to the bit 230 via the steering device 260.

e) Steering Device 260

The steering device 260 is integrally connected to the drilling motor 250 on the one hand and to the bit 230 on the other hand.

The steering device 260 is in the form of a hinged tube configured both to receive the increased power provided by the drilling motor 250 and to transmit said increased power to the bit 230, to direct the bit 230 in a given direction and to transfer the fluid flow from the turbine 210 via the drilling motor 250 to the bit 230.

f) Bit 230

With reference to FIG. 2, the bit 230 is connected to the steering device 260 via a tubular connection portion 270 so as to extend out of the hollow cylindrical body 110 of the stator assembly 10 through the free end 110B. The bit 230 is rotary about an axis of rotation X.

The bit 230 comprises a bit body 231 having a drilling face 231A and an attachment face 231B (FIG. 2). The drilling face 231A is configured to come into contact with the rock in order to grind it. The attachment face 231B is configured to attach the bit 230 to the tubular connection portion 270 such that the bit body 231 and the tubular connection portion 270 are coaxially connected.

The bit body 231 delimits a through channel 231C for passing the fluid flow connecting the attachment face 231B, at the connection to the tubular connection portion 270, to the drilling face 231A by opening at a circular central face opening 231A1 of the drilling face 231A (FIG. 3) to allow the fluid flow to circulate from the bit 230 to the rock in order, especially, to discharge rock debris.

With reference to FIGS. 3 and 4, the bit 230 comprises a high-voltage electrode 232C disposed in the center of the central face opening 231A1 and having a half-sphere shape whose axis is the same as the axis of rotation X. The axis of rotation X passes through the center of the central face opening 231A1 and the center of the high-voltage electrode 232C.

The bit body 231 comprises an outer surface 232 extending from the central face opening 231A1 to the attachment face 231B and from which a plurality of drilling (or cutting) members 233 adapted to break the rock extend.

The drilling members 233 are preferably made as one piece with the bit body 231 and are evenly distributed on the outer surface 232, around the bit body 231. In the illustrated example, which is in no way limiting, the bit 230 comprises six drilling members 233.

Each drilling member 233 comprises a fin 233A made as one piece with the outer surface 232 by extending radially in a curved manner in the opposite sense to the rotation of the drilling bit 230 for a drilling efficiency purpose.

Each fin 233A comprises a distal end extending partially into the central face opening 231A1 and a proximal end located at the junction between the outer surface 232 and the attachment face 231B (FIG. 2). Each pair of adjacent fins 233A delimits a groove 234 allowing especially drilling mud to be discharged.

Drilling teeth 233B are made as one piece with the fin 233A by being distributed side-by-side along the fin 233A from the distal end towards the proximal end. In the example of the figures, especially in FIG. 4, each drilling member 230 comprises five drilling teeth 233B.

As shown in FIGS. 2-4, each drilling tooth 233B extends from the fin 233A in an orthogonal direction to the axis of rotation X of the bit 230 so as to excavate the rock efficiently. As shown in FIG. 2, the assembly comprising each first drilling tooth of each drilling member 233 forms the end of the bit body 231 first coming into contact with the rock.

The high-voltage electrode 232C is disposed recessed from the first drilling teeth 233B of each drilling member 233, that is, recessed in the through channel 231C for passing fluid, in order to protect it from friction from the rock during rotation of the bit 230.

With reference to FIGS. 3 and 4, each drilling tooth 233B comprises a base 233B1 and a cutting element 233B2. The base 233B1 is made as one piece with the fin 233A and is substantially cylindrical in shape extending in an orthogonal direction to the axis of rotation X of the bit 230. The cutting element 233B2 is disposed at the end of the base 233B1 in the rotation sense of the bit 230 in order to drill the rock by rotation of the rotor assembly 20. The cutting element 233B2 is made of a hard, abrasive drilling material, for example from interconnected polycrystalline diamond particles, comprising the "polycrystalline diamond compact" (PDC) type. The cutting elements 233B2 may be manufactured separately from the bit body 231 and then attached to the bases 233B1 using a bonding material such as a soldering alloy.

Each drilling member 233 comprises a ground electrode 233C placed at the end of the fin 233A, at the high-voltage electrode 232C, so as to extend at least partially in line with the central face opening 231A1. As with the high-voltage electrode 232C, each ground electrode 233C is disposed recessed from the first drilling teeth 233B of the drilling members 233, that is, recessed in the through channel 231C for passing fluid, in order to protect it from friction from the rock during rotation of the bit 230. Advantageously, each ground electrode 233C has a half-sphere shape, the axis of which may be inclined slightly towards the high-voltage electrode 232C, for example between 0 and 30°, in order to improve the formation of an electric arc between the high-voltage electrode 232C and said ground electrode 233C.

The high-voltage electrode 232C and the ground electrodes 233C are made of an electrically conductive material, for example metal such as, preferably, steel.

Each pair of electrodes formed by the high-voltage electrode 232C and a ground electrode 233C is configured to trigger an electric arc when said pair receives a voltage delivered across the same by the high-power pulse generator 220.

II) Implementation

The fixed-cut drilling bit 230 may be placed in a borehole so that the cutting elements 233B2 abut against the rock formation to be drilled, the high-voltage electrode 232C and the ground electrodes 233C being protected from the rock by the drilling teeth 233B.

In order to rotatably drive the rotor assembly 20, and therefore the bit 230, a fluid, for example of mud type, is sent by the drilling rod 2 into the turbine 210 in order to rotatably drive it.

The power generator 240, driven by the turbine 210, then generates a charging current enabling the capacitors of the high-frequency pulse generator 220 to be recharged through an adapted electronic circuit.

Once it has passed through the turbine 210, the fluid flow passes through the drilling motor 250 which increases the power (torque) transmitted to the bit 230 in order to drill the rock by rotation.

During rotation of the bit 230, the cutting elements 233B2 scrape and shear off the surface of the underlying formation. At the same time, the high-frequency pulse generator 220 periodically applies, for example between 0.5 and 50 pulses per second, preferably 30 pulses per second, a voltage between the high-voltage electrode 232C and the ground electrodes 233C in order to trigger the formation of an electric arc allowing rock fragments to be generated, which removes the significant mechanical stresses on the bit that should have been applied to the same to generate these fragments.

By passing through the bit body 231 to open at the central face opening 231A1, the through channel 231C allows the fluid flow to be conveyed through the bit body 231 so that the fluid circulates continuously around the high-voltage electrode 232C, thus forming a fluid screen having a dielectric function allowing the electric arc to form between the high-voltage electrode 232C and one of the ground electrodes 233C. The fluid flow conveyed through the bit 230 also allows rock debris to be discharged from the drilling area to the top of the wellbore.

With the rotation of the bit, the ground electrodes 233C have a tangential velocity greater than the tangential velocity of the high-voltage electrode 232C, which is close to zero since the high-voltage electrode 232C is located in the center of the drilling face 231A of the bit body 231. Thus, when voltage is applied between the high-voltage electrode 232C and the ground electrodes 233C, the fluid flow surrounding the high-voltage electrode 232C creates an effective medium that ensures the formation of an electric arc in the rock between the high-voltage electrode 232C and one of the ground electrodes 233C while the bit 230 is rotating.

The fluid thus has a dual function: a dielectric function because, between the fluid and the rock, the electric arc will favor passage through the rock and thus fracture it and a drilling mud function as the fluid circulation allows rock debris to be discharged, by conveying it to the surface. In addition, the fluid flow allows cleaning of the inter-electrode area.

The invention claimed is:

1. A bit for drilling tool, said bit comprising a bit body having a drilling face and an attachment face for attaching the bit to a rotor assembly of the drilling tool, said bit body delimiting a through channel for passing fluid flow connecting the attachment face to the drilling face by opening at a circular central face opening of the drilling face, the drilling face comprising an outer surface connecting the central face opening to the attachment face and from which a plurality of drilling members evenly distributed on said outer surface extend, each drilling member comprising a fin, extending radially from the outer surface from the attachment face into the central face opening, and a plurality of drilling teeth extending from said fin by being disposed side-by-side between a first drilling tooth located at the end of the drilling face and a last drilling tooth located on the side of the attachment face, and each comprising a base and a cutting element disposed at the end of said base, the bit comprising a high-voltage electrode disposed in the through channel, in the center of the central face opening recessed from the first drilling tooth of each drilling member, each drilling member comprising a ground electrode placed at the end of the fin, at said high-voltage electrode, so as to extend at least partially in line with the central face opening recessed from the first drilling tooth of said drilling member.

2. The bit according to claim 1, wherein the drilling members are evenly distributed on the outer surface around the bit body.

3. The bit according to claim 1, wherein the bit body comprises at least three drilling members.

4. The bit according to claim 1, wherein the fins are made as one piece with the outer surface of the bit body.

5. The bit according to claim 1, wherein the bases of teeth of a drilling member are made as one piece with the fin of said drilling member.

6. The bit according to claim 1, wherein the fins extend onto the outer surface in a curved manner in the opposite sense to the rotation of the drilling bit.

7. The bit according to claim 1, wherein each drilling member comprises at least three drilling teeth.

8. The bit according to claim 1, wherein the base is substantially cylindrical in shape extending in an orthogonal direction to the axis of rotation of the bit.

9. The bit according to claim 1, wherein the cutting elements are made of interlinked polycrystalline diamond particles to form a hard, abrasive drilling material.

10. The bit according to claim 1, wherein, the ground electrodes being identical, the high-voltage electrode and the ground electrodes each have at least partially a spherical shape.

11. The bit according to claim 1, the electrodes each having at least partially a spherical shape, the diameter of the high-voltage electrode is at least equal to twice the diameter of each ground electrode in order to allow the formation of an electric arc between the high-voltage electrode and any of the ground electrodes.

12. A pulsed high-power rotary drilling tool, said drilling tool comprising a stator assembly and a rotor assembly, said stator assembly comprising a hollow cylindrical body comprising an attachment end, adapted to be connected to a drilling rod, and a free end, said rotor assembly comprising a turbine, mounted inside the body at the attachment end and configured to be driven by a fluid flow provided by the drilling rod in order to rotatably drive said rotor assembly, a high-power pulse generator mounted inside the body and integrally connected to the turbine, and a bit according to one of the preceding claims extending out of the cylindrical body at the free end of the stator assembly.

13. The drilling tool according to claim 12, further comprising an electricity generator configured to convert the mechanical energy of the rotating turbine into electrical energy in order to supply the high-power pulse generator.

14. The drilling tool according to claim 12, further comprising a drilling motor mounted inside the body, integrally connected to the high-power pulse generator and configured to be driven by the fluid flow having passed through the turbine.

15. The drilling tool according to claim 14, further comprising a steering device integrally connected to the bit and being in the form of a hinged tube configured to receive the power provided by the turbine or the increased power provided by the drilling motor and transmit said power to the bit, to direct the bit in a given direction and to transfer the fluid flow from the turbine to the bit.

* * * * *